US005271436A

United States Patent [19]

Pfender et al.

[11] Patent Number: 5,271,436

[45] Date of Patent: Dec. 21, 1993

[54] MACHINE AND METHOD FOR PRODUCING REINFORCING CAGES FOR CONCRETE PIPES

[75] Inventors: Albert Pfender; Klaus Mehre, both of Kisslegg, Fed. Rep. of Germany

[73] Assignee: MBK Maschinenbau GmbH, Kisslegg, Fed. Rep. of Germany

[21] Appl. No.: 880,037

[22] Filed: May 8, 1992

[30] Foreign Application Priority Data

Mar. 7, 1992 [EP] European Pat. Off. ..... 92103943.4

[51] Int. Cl.[5] ..... B21F 31/00

[52] U.S. Cl. ..... 140/112

[58] Field of Search ..... 140/92.2, 112

[56] References Cited

U.S. PATENT DOCUMENTS

| | | | |
|---|---|---|---|
| 2,903,553 | 9/1959 | Butler . | |
| 4,625,773 | 12/1986 | Pfender | 140/112 |
| 5,020,575 | 6/1991 | Grabuschnig et al. | 140/112 |

FOREIGN PATENT DOCUMENTS

| | | | |
|---|---|---|---|
| 1552159 | 5/1970 | Fed. Rep. of Germany . | |
| 2720970 | 11/1978 | Fed. Rep. of Germany | 140/112 |
| 2945556 | 5/1981 | Fed. Rep. of Germany . | |
| 2946297 | 5/1981 | Fed. Rep. of Germany . | |
| 3611482 | 10/1987 | Fed. Rep. of Germany . | |
| 2038417 | 1/1971 | France . | |

*Primary Examiner*—Lowell A. Larson

*Attorney, Agent, or Firm*—Spencer, Frank & Schneider

[57] ABSTRACT

A machine for producing reinforcing cages for concrete pipes is described, the reinforcing cages comprising longitudinal wires and a winding wire wound around them and welded to them at the intersections. In order to make manual work superfluous and to improve the machine performance, a wire feed device is provided which automatically fits the machine with the required longitudinal bars before each winding process. The device comprises a feed apparatus (21) for a plurality of wires (33), adjoining guide tubes (37), whose mouths are aligned with the collecting funnels (9), and a cutting device (38). The said machine parts may be combined to form a feed frame (44) which can be displaced longitudinally altogether. Guide mouthpieces (39) are distributed uniformly over the circumference on the same diameter as the cutting devices (38) on a supporting disk (51) which is rotationally fixed to the main disk but can be displaced longitudinally with the feed frame (44). When there are fewer feed channels than the maximum number of longitudinal bars which can be inserted, the fitment process takes place in a cyclic method which permits a plurality of fitment variants.

7 Claims, 4 Drawing Sheets

MACHINE AND METHOD FOR PRODUCING REINFORCING CAGES FOR CONCRETE PIPES

DESCRIPTION

Figure 10:
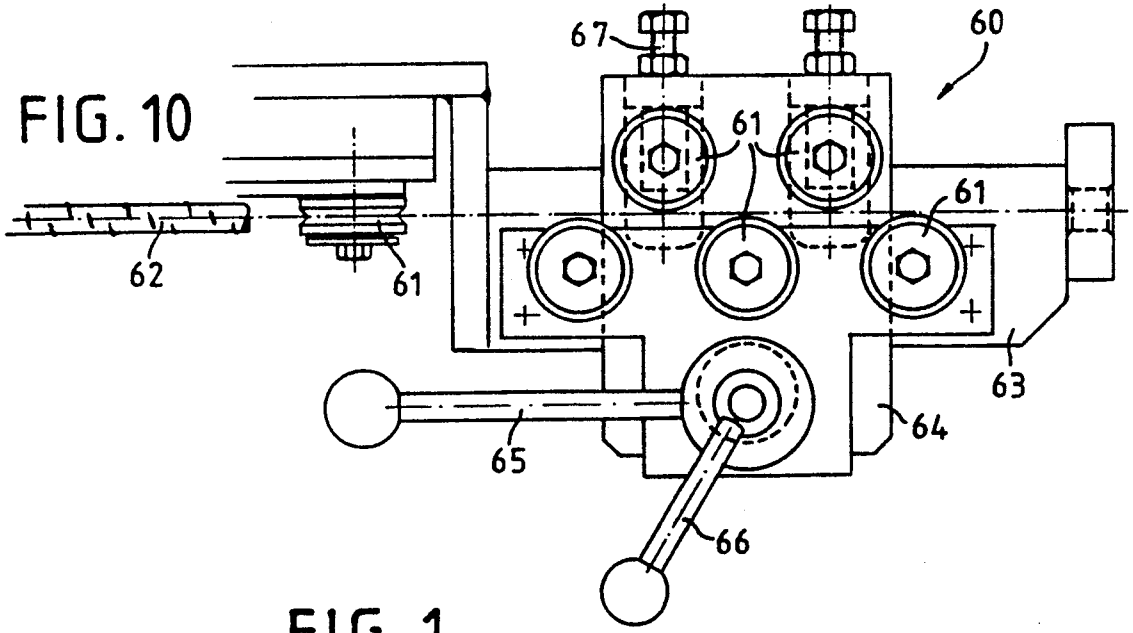

The invention relates to a machine for producing reinforcing cages for concrete pipes. The reinforcing cages have longitudinal wires and a winding wire wound around and welded to the longitudinal wires at points of intersection. The longitudinal wires are cut to length for winding and are inserted through collecting funnels and held in a fixed main disk and an axially displaceable supporting disk. The disks are coaxially supported and synchronously rotated. Such a machine is disclosed in DE-C 29 46 297. In this case, the longitudinal wires are drawn off a supply roller placed on a spool, are aligned and cut to length in a separate, preparatory procedure. The longitudinal bars produced in this way are fed by hand into the machine, in the required quantity, through collecting tubes which are equipped with collecting funnels. This type of fitment takes a relatively long time, and, including the alignment of the longitudinal bars, represents a considerable labor cost factor.

Another machine to produce the same reinforcing cages is disclosed in FR-A-2,038,417. In this case, the longitudinal wires are not cut to length before producing the cage, but are fed continuously. The drum arrangement, consisting of the longitudinal wires, thus does not rotate, but the supply roller for the winding wire and the welding device are arranged on a ring which surrounds the tensioned longitudinal wires and rotates around them.

The cage grows continuously from this ring. It can be cut off at the desired length. However, the principle of the rotating welding device is relatively complicated and is, in any case, limited where reinforcing cages of very different diameters are required.

The invention is based on the object of rationalizing the fitment of longitudinal bars to a reinforcing cage winding machine of the type mentioned initially, i.e. to render manual work superfluous and to improve the machine performance, i.e. the ratio of manufacturing time to fitment time.

This object is achieved on the basis of such a machine according to the invention wherein a wire feed device is provided which automatically fits the machine with the required longitudinal bars before each winding process. The wire feed device preferably comprises a feed apparatus for a plurality of wires, which are drawn off spools, adjoining guide tubes, whose mouths are aligned to the collecting funnels of the machine, and a cutting device for the wires.

The feed apparatus preferably includes a plurality of roller pairs per wire, one behind the other, in each case one roller being supported fixedly and the other resiliently, so that slip-free wire feed is achieved and the wire is simultaneously aligned straight to a certain extent. The cutting device can be constructed in the manner of shears for one or more wires and can be driven by means of a hydraulic cylinder. In order that the cut-off ends of the longitudinal bars, which are still located in the cutting device, can rotate with the main disk, they must be drawn out of the cutting device. This can take place, for example, with the aid of the moveable supporting disc, on which the opposite ends of the longitudinal bars are mounted with the aid of clamps. However, it is also conceivable to fit to the collecting tubes simple follow-up movement devices which grip the longitudinal bars fed in and displace them a short distance towards the supporting disk in order to expose the cut-off ends.

With the aid of suitable electronic control devices, the wire feed, the cutting off and the follow-up movement of the cut-off longitudinal bars can be controlled completely automatically and can be carried out after each complete reinforcing cage is ejected. It is necessary only that, to feed the wires, the collecting tubes are set such that they are aligned with the guide tube mouths. Manual work is no longer necessary, and the reduction in the fitment time allows a considerable increase in the machine performance to be achieved.

If the reinforcing cage winding machine is set up for cages with a relatively large number of longitudinal bars, or a different number of longitudinal bars, the number of longitudinal wire spools required and the technical cost for the wire feed device would exceed a reasonable level. A method for longitudinal bar fitment is therefore proposed in a development of the invention for this case which comprises only a first group of longitudinal wires being fed in initially, which are distributed at equal angular intervals around the circumference and represent an integer fraction of the total number of longitudinal bars which can be held by the machine, these longitudinal wires being cut off and the main disk then being further rotated through a respectively corresponding angle, and the remaining groups being fed in and cut off in a cyclic manner. The wire feed device can thus be of correspondingly simple construction. The number of guide tubes, the roller sets of the feed apparatus and the cutting devices provided in each case for a longitudinal wire to be fed likewise need to be equal only to an integer fraction of the total number of longitudinal bars which can be held by the machine.

The follow-up movement of the longitudinal bars from the cutting devices could turn out to be problematic, particularly when welding supports and collecting tubes are arranged such that they can be moved radially on the main disk to produce reinforcing cages of different diameters. In a development of the invention, it is proposed that the wire feed device have a feed frame which connects its feed apparatus, its guide tubes and its cutting device and can be displaced longitudinally. In consequence, in order to release the longitudinal bar ends from the cutting devices, it is possible to move the complete feed frame a short distance backwards and move it forwards again before feeding in the next wire group.

This construction additionally has the advantage that reinforcing cages of different length can be produced, the possible movement distance of the feed frame determining the length variation range of the reinforcing cages to be produced. In this case, the collecting tubes on the main disk are made as long as the shortest possible longitudinal bars. Before feeding in a wire group, the feed frame now moves until it is close to the collecting funnels in order that the start of the wires are reliably inserted into it. If the wires are now fed in up to a short distance beyond the welding supports, the feed frame thus moves back with the feed apparatus running to the desired longitudinal bar length. In this case, the rate of movement is expediently equal to the feed rate of the wire in the feed apparatus, so that the wire remains stationary. The longitudinal wires are cut off at the desired point.

It is expedient to provide a cutting device for each individual wire, devices having two laterally moving cutting bushes having been proven. The cutting devices can be fitted on a supporting ring mounted on the feed frame. In this case, it is important for the supporting ring to have openings between the cutting devices in the region of the arc corresponding to the axial separation between the cut wires. When, specifically, one wire group is cut off and, after an intermediate angular movement of the main disk, the feed frame moves forwards to feel in the next group, the cut off ends of the previous group thus pass through the openings in the supporting ring, so that the movement of the feed frame is not impeded.

It is further proposed that guide mouthpieces, arranged directly behind the cutting devices in the feed direction, be arranged on a support disk which can rotate with the main disk and can be displaced longitudinally with the feed frame. These guide mouthpieces fulfill two objects. On the one hand, they ensure that the previously cut off ends of the longitudinal bars, facing away from the main disk, are inserted into the said openings of the supporting ring when the feed frame is moved forward after each cyclic rotation. On the other hand, they ensure that the projecting front wire ends are inserted in the collecting funnels. To this end, the guide mouthpieces are expediently of conical construction at the front end and, when they are moved up to the collecting funnels, they engage therein. In other respects, the guide mouthpieces are dimensioned and arranged such that, when the feed frame moves backwards a short distance, as already mentioned, after each cutting process, although the longitudinal bar ends are drawn out of the cutting devices, they still remain in the guide mouthpieces, which follow the rotary movements with their supporting disk.

In detail, it is expedient from the structural point of view if a common hub, which is rotationally fixed and can be displaced longitudinally, is arranged on the extended shaft of the main disk, on which hub the supporting disk of the guide mouthpieces is mounted and which is held on the feed frame by an axial driving connection.

Since the collecting tubes projecting from the main disk are relatively long, there is a risk, despite the use of reinforcing arms, of the collecting funnels swinging out in the tangential direction and hence missing the guide mouthpieces. In this case, care must be taken to ensure that the collecting tubes must be moveable radially along the main disk to produce reinforcing cages of different diameters. It is thus proposed that the collecting tubes be supported by a guide star which is mounted on the shaft of the main disk and forms radial slots.

Figure 1:
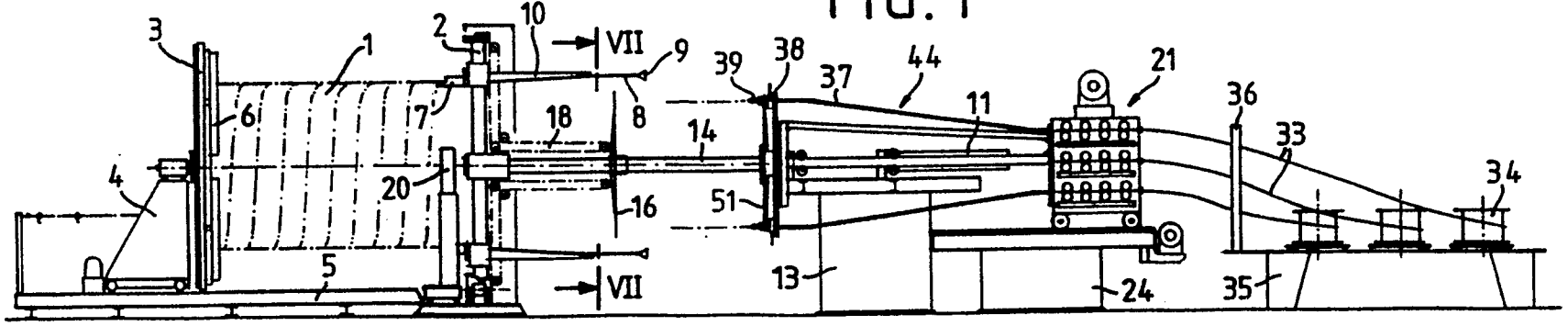
Figures 2, 3:
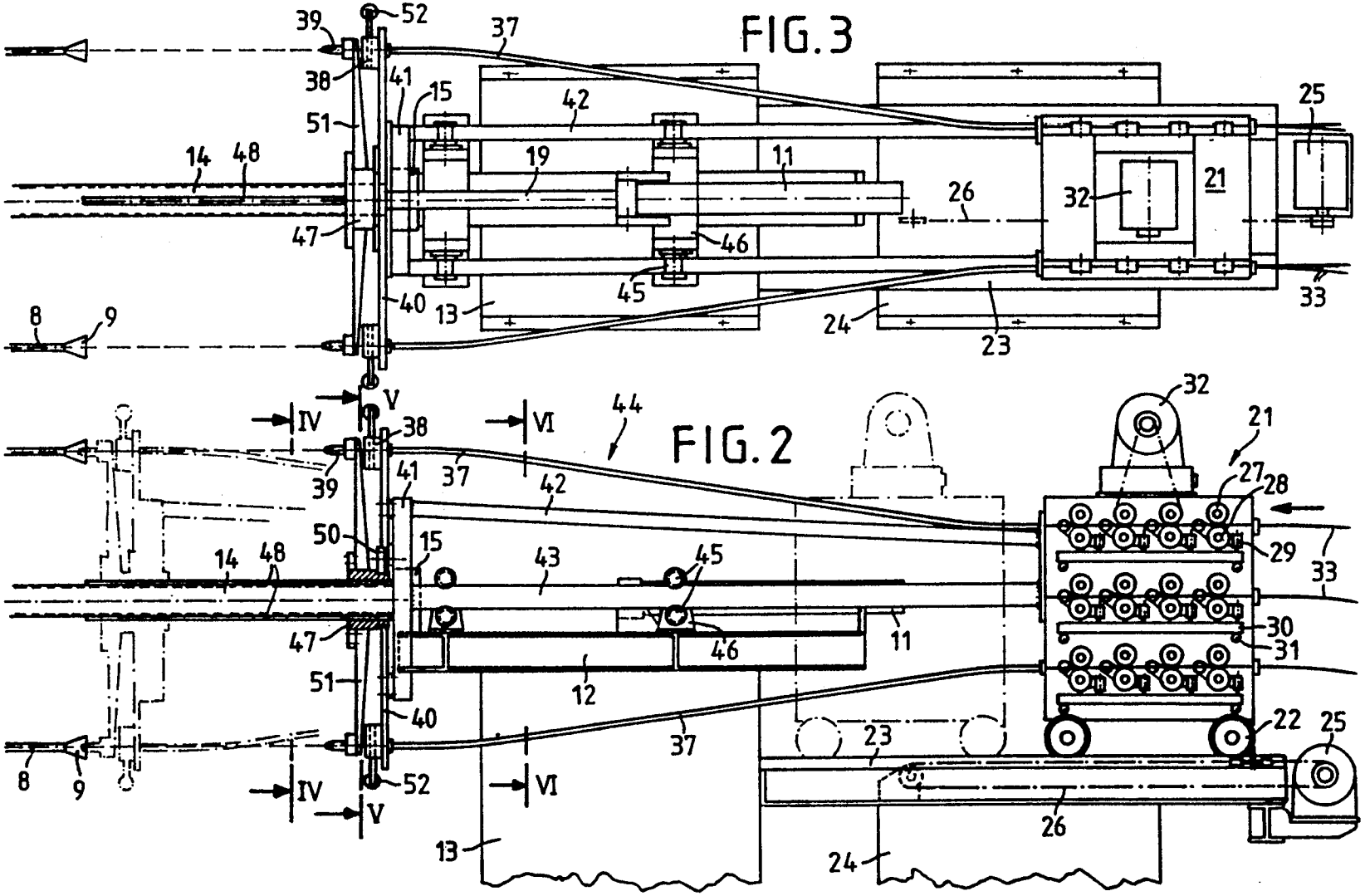
Figure 7:
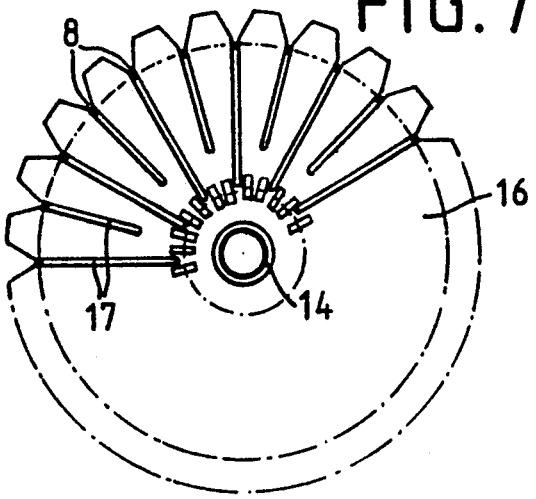
Figure 5:
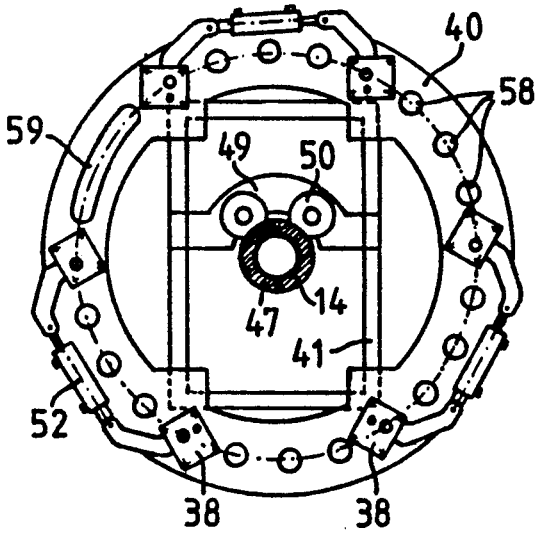
Figure 4:
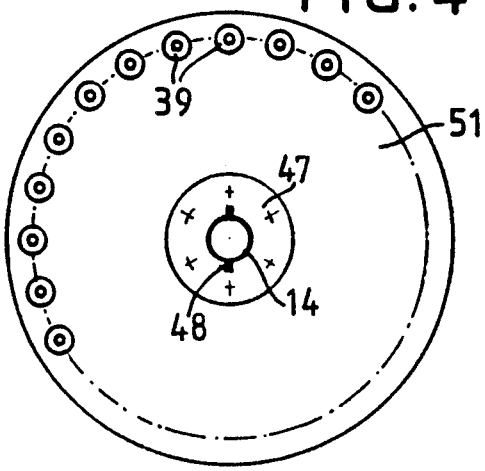
Figure 6:
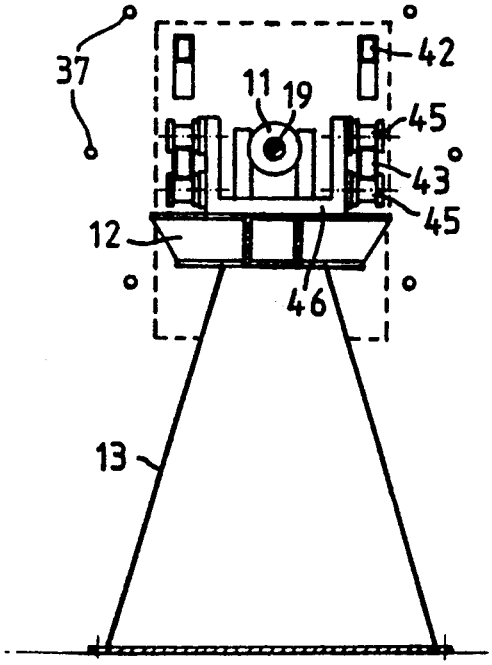
Figure 8:
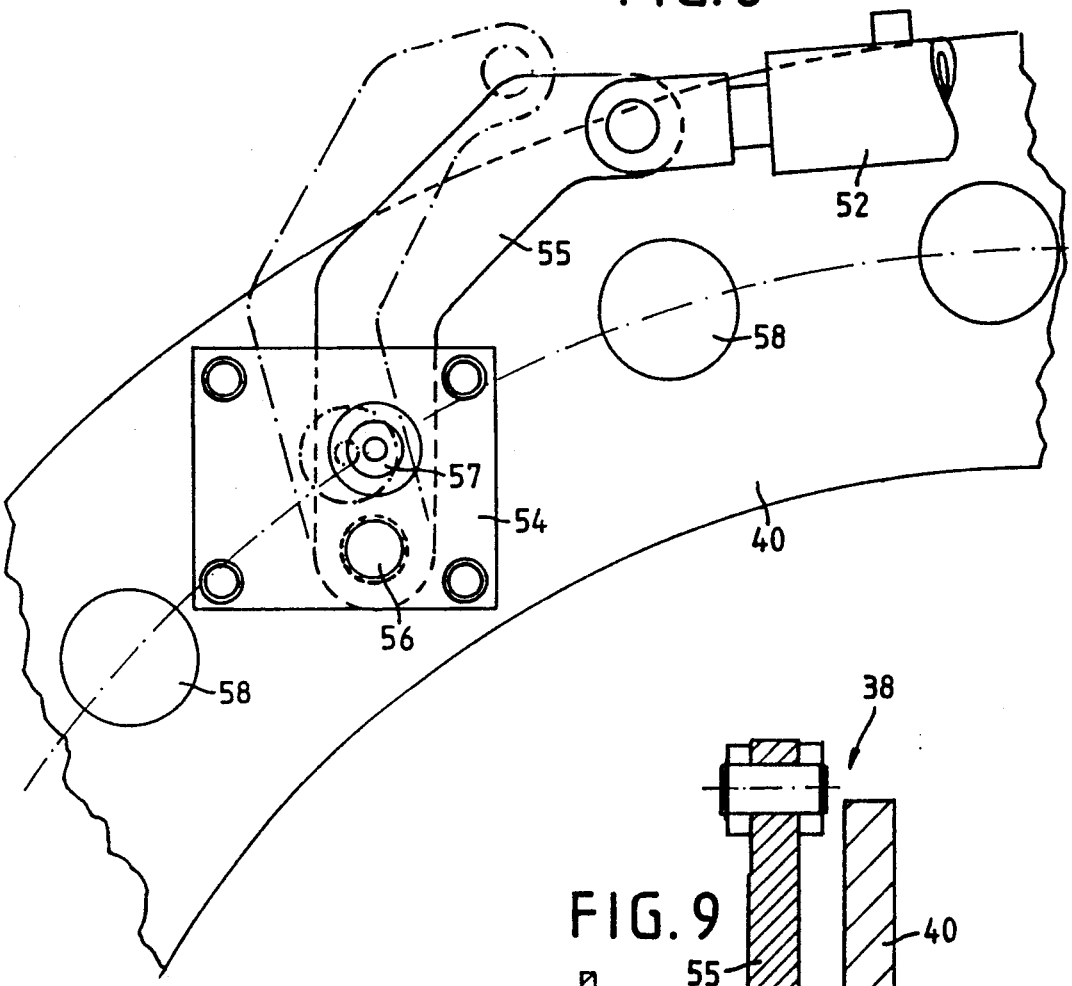
Figure 9:
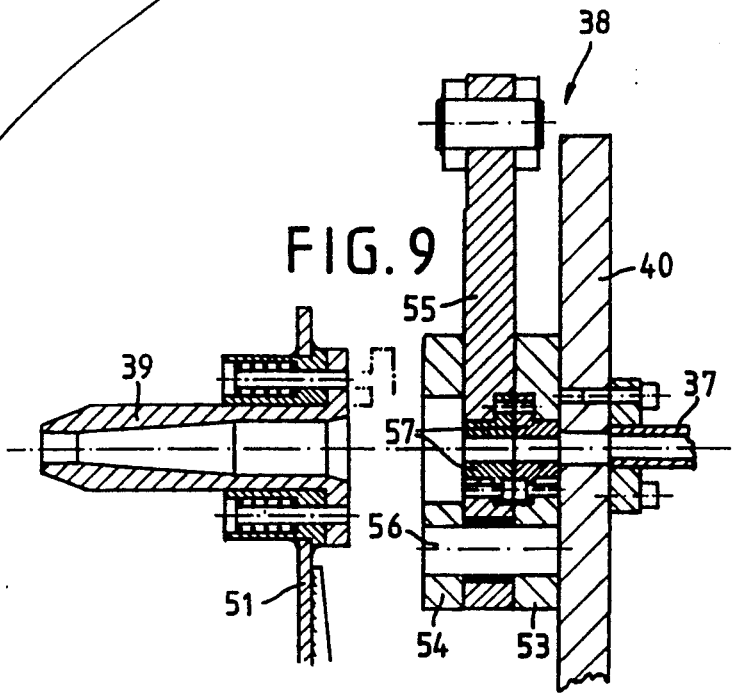

An exemplary embodiment of the invention is explained in the following text, using the drawing in which, in detail:

FIG. 1 shows the side view of a complete reinforcing cage winding machine with automatic feed of the longitudinal bars, FIG. 2 shows the side view of the wire feed device of this machine, on a larger scale, FIG. 3 shows the wire feed device seen from above, FIG. 4 shows an axial view IV—IV of the supporting disk with the guide mouthpieces according to FIG. 2, FIG. 5 shows an axial view V—V of the supporting ring with the cutting devices according to FIG. 2, FIG. 6 shows a cross-section VI—VI of the longitudinally moveable frame of the wire feed device according to FIG. 2, FIG. 7 shows an axial view VII—VII of a guide star on the main disk according to FIG. 1, FIG. 8 shows the axial view of a cutting device according to FIG. 5, on a larger scale, FIG. 9 shows an axial section of the cutting device according to FIG. 8, and FIG. 10 shows the view of a module of an additionally proposed wire alignment device.

The machine according to FIG. 1, without a wire feed device, corresponds essentially to the machine described in DE-C 2,945,556 and, in particular, DE-C 2,946,297, for producing reinforcing cages. Reference is made thereto as a supplement to the following description.

An existing barrel-shaped reinforcing cage 1 is held between a main disk 2 and a supporting disk 3. These disks, which are constructed as spoked wheels with 24 spokes, are supported on the same axis and can be driven precisely synchronously with the aid of an electric drive. The support of the main disk is stationary, the supporting disk 3 being supported on a carriage 4 which can move in the axial direction on two track rails 5. The supporting disk furthermore has radial clamping strips 6 which form slots between them and firmly clamp the longitudinal bars of the reinforcing cage 1 which project into these slots, to be precise independently of the cage diameter.

On its spokes, the main disk 2 has welding supports 7 which can be displaced radially, guide the longitudinal bars and provide inward support when the crossing winding wire is welded on. In order to be able to feed the longitudinal wires more easily into the welding supports 7, a collecting tube 8 which projects in the axial direction and has a collecting funnel 9 on the receiving end, is arranged on each of these welding supports. In the example and in connection with the invention, the collecting tubes 8 are relatively long and are thus supported by reinforcing arms 10 which are likewise mounted on the welding supports 7.

A chain arrangement, which is operated by a hydraulic cylinder 11, is used for the common radial displacement of the individual welding supports 7. Said cylinder is seated on an elongated platform 12 (FIG. 2) which is supported by a pedestal 13. The main disk 2 has a hollow shaft 14 which is fixedly connected to its hub, is of particularly long construction with respect to the invention, and is supported in a bearing 15 mounted on the platform 12 (FIG. 2). This hollow shaft 14 supports a guide star 16 which is shown more clearly in FIG. 7. It consists of a round disk with 24 radial slots 17, whose edges are open, open in a V-shape towards the edge and each hold a collecting tube 8. The chain arrangement in each case comprises an endless chain 18, guided in an L-shape, per spoke, which is guided over four guide rollers. One of these guide rollers is seated on the outer ring of the main disk 2, two more being seated on the hub and the fourth being seated on the guide star 16. One of the chain sections extending radially is mounted on the associated welding support 7. The corresponding axial sections of all the chains are mounted on a common annular sleeve which can be displaced on the hollow shaft 14. The annular sleeve is a diametric web which passes through two longitudinal slots in the hollow shaft and is connected to the extended piston rod 19 of the hydraulic cylinder 11 (FIG. 3) which piston rod 19 engages axially in the hollow shaft 14. A welding device, indicated by 20, can move at right angles to the longitudinal axis of the machine in synchronism with the radial displacement of the welding supports 7.

The machine which is known to this extent—with the exception of the guide star 16—is equipped with an automatic device for feeding in six longitudinal wires, which are shown in the other figures. Referring to FIGS. 2 and 3, the machine comprises a feed apparatus 21, which has four track rollers 22 and can be moved on two rails 23. The rails rest on a pedestal 24. The movement drive takes place by means of a precisely controllable motor 25 and an endless chain 26. A spindle or other linear drive could also be used in the same manner. Three roller sets are arranged in each case on the exterior on the side walls of the base body, which is open in the movement direction, of the feed apparatus 21. In the example, each comprises four upper fixedly supported rollers 27 and four lower rollers 28, which are supported in an oscillating manner on guide bars and are pressed against the upper rollers with the aid of plate spring stacks 29. Located under each roller set is a clamping strip 30 which rests on two eccentric rollers 31 such that the pretensioning of the plate spring stacks 29 can be varied as required by adjusting the eccentric rollers. All the upper rollers 27 are driven by a motor 32 arranged on the feed apparatus 21.

The feed apparatus 21 draws six longitudinal wires 33 from six wire reels 34, which are supported with their vertical axes in two rows on a spool frame 35. In each case, three wires run through a slotted frame 36, for prealignment, to the left and right roller sets of the feed apparatus 21 (FIG. 1).

The longitudinal wires 33 are fed from the feed apparatus 21 in each case through six guide tubes 37, cutting devices 38 and guide mouthpieces 39. The cutting devices 38 are arranged on a supporting ring 40 which is fixedly connected to a rectangular frame 41. This vertical frame is in turn fixedly connected via two upper bars 42, running obliquely, and two horizontal, lower rails 43 to the base body of the feed apparatus 21, to form a feed frame 44 which can be moved therewith. The rails 43 thereof are guided longitudinally between in each case two roller pairs 45 which are supported on two U-shaped crossbars 46 of the platform 12.

A hub 47 is supported displaceably on the hollow shaft 14. Two strips 48, which are mounted diametrically opposite one another on the hollow shaft, engage in corresponding inner longitudinal grooves in the hub 47 so that the latter cannot rotate with respect to the hollow shaft 14. Externally, the hub 47 has a circumferential groove into which there engage two freewheeling rollers 50 which are supported on an intermediate bracket 49 of the rectangular frame 41. This results in the feed frame 44 driving the hub 47 in both directions during its longitudinal movement, the hollow shaft being able to rotate with the hub. Mounted on the hub 47 is a supporting disk 51 to which the 24 guide mouthpieces 39 are fitted at angular intervals of 15°. When the feed frame 44 together with the feed apparatus 21 moves to the left, under the influence of the motor 25 according to FIG. 2, into the position shown by dashed-dotted lines, the rear part of the platform 12 and the hydraulic cylinder 11 engage between the two side walls, supporting the roller sets, of the base frame of the feed apparatus 21. In this case, the six curved guide tubes 37, of which only two are shown in each case for simplicity, are also not impeded by the platform 12 or its pedestal 13.

As FIG. 5 shows, in each case two of the total of six cutting devices 38 are operated by a hydraulic cylinder 52. Such a cutting device is shown more clearly in FIGS. 8 and 9. It consists of two rectangular plates 53 and 54, screwed to one another, between which a lever 55 is supported by means of a bearing bolt 56 which passes through the plates. The piston rod of the hydraulic cylinder 52 is jointed to this lever 55 according to FIG. 8. In each case one of two hardened cutting bushes 57, which are arranged in mirror image form and whose end surfaces slide directly on one another, are seated in the plate 53 and in the lever 55. In the rest position of the lever 55, shown drawn out, the two cutting bushes 57 are aligned with a hole in the supporting disk 40, with the guide tube 37 which opens therein and with a larger opening in the plate 54. In this position, a longitudinal wire can thus be fed in. If the hydraulic cylinder is operated, the wire is cut off. FIG. 5 and FIG. 8 show round openings 58, whose purpose becomes clear from the further description, which are fitted on the supporting ring 40. Their center points lie on the same circle arc as the openings of the cutting devices 38 and are at the same angular intervals. Any three openings 58, arranged between two cutting devices 38, could be replaced by a kidney-shaped slot 59, as is also shown in FIG. 5.

It has already been mentioned that the roller sets of the feed apparatus 21, whose rollers press against one another in pairs, have only a limited alignment effect on the wire. On the other hand, good, straight alignment of the longitudinal wires fed is of major importance to the dimensional stability of the reinforcing cages. In the case of stringent requirements in this respect and critical wire material, there are therefore arranged between the spool frame 35 and the feed apparatus 21 alignment devices which comprise a plurality of modules 60, one of which is shown in FIG. 10. The module contains five rollers 61, which are on parallel axes, are V-shaped on the circumference, and are arranged alternately on both sides at longitudinal intervals in the running direction of the wire 62 to be treated. The three lower rollers are supported on the fixed alignment frame 63, while the two upper rollers are supported on a cross slide 64 which can be displaced in corresponding guides under the three lower rollers. The cross slide 64 can be adjusted by means of an eccentric which is supported in the alignment frame and whose operating lever is designated by 65 such that the wire passing through is slightly bent twice and in consequence is aligned straight in the plane of the rollers. The eccentric and the cross slide 64 can be fixed by means of a clamping lever 66. Adjusting screws 67 furthermore permit individual adjustment of the two upper rollers 61. At least two such modules 60 per wire are arranged one behind the other in mutually perpendicular planes, by means of which complete spatial straight alignment can be achieved. The second module is indicated partially.

The machine described is set up for the production of reinforcing cages having a maximum of twenty four longitudinal bars, i.e. in each case twenty four clamping slots are provided on the support disk 3, welding supports 7 and collecting tubes 8 on the main disk 2, radial slots 17 on the guide star 16 and guide mouthpieces 39 on the supporting disk 51. On the other hand, only one group of six longitudinal wires can be fed in at one time, because the wire feed device in each case has only six feed roller sets, guide tubes 37 and cutting devices 38. The diameter of the reinforcing cage can be larger or smaller than the delivery diameter, i.e. the diametric separation of the guide mouthpieces. Fewer longitudinal bars are normally used in the case of small cage diameters and more longitudinal bars in the case of large cage diameters. In the representation according to FIG. 1, the reinforcing cage 1 has virtually the maximum diameter.

The machine described operates under these preconditions, for example to produce a reinforcing cage having twelve longitudinal bars, as follows: when the complete reinforcing cage has been removed and the supporting disk 3 has been moved to the right again into the vicinity of the main disk 2, the welding supports 7 and the collecting tubes 8 move radially inwards, controlled by the hydraulic cylinder 11, until they are in the position shown in FIGS. 2 and 3, i.e. on the delivery diameter. The axis separation of the collecting funnels 9 is the same size as that of the guide mouthpieces 39 in this position. By means of the radial movement, the collecting tubes 8 are simultaneously run into the guide slots 17 of the guide star 16 as a result of which a precise angular separation of 15° in each case is ensured. Otherwise, the rotational control of the main disk 2 moves it, and hence also the guide star 16 and the supporting disk 51, into an angular position in which six of the total of twenty four guide mouthpieces 39 are aligned with the mouths of the guide tubes 37, i.e. the openings of the cutting devices 38. At the same time, the feed frame 44 is moved by the influence of the motor 25 to the left into the delivery position according to FIG. 2, shown in dashed-dotted lines, the guide mouthpieces 39 engaging by a short distance into the collecting funnels 9. In order to ensure complete engagement, but to prevent damage, because of the unavoidable tolerances in the movement of such large machine parts, the guide mouthpieces 39 are installed in the supporting disk 51 in a resiliently flexible manner, as FIG. 9 shows.

This is now the time at which the motor 32 sets the roller sets of the feed apparatus 21 in motion, so that, as a result of the effect of these rollers, whose running surface can be ridged, the six wires 33 are fed into the guide tubes 37. The front ends of said wires 33 pass through the cutting devices 38 and the guide mouthpieces 39 into the collecting funnels 9 and the collecting tubes 8 until the front ends project several centimeters beyond the welding supports 7. At this instant, the feed frame 44 once again starts to move back to the right, to be precise preferably at the same rate at which the wires 33 move forward in the guide tubes 37. In consequence, the wires remain stationary in the collecting tubes 8. If the said rates do not correspond precisely or if the switching-off times of the drives do not correspond precisely, this can be compensated for by control means. In any case, the two drives 25 and 32 come to rest when the desired length of the longitudinal bars is reached. This can be in the limit position shown in the drawings or in any intermediate position. The hydraulic cylinders 52 of the cutting devices 38 are now operated and the six wires 33 are hence cut off. The cut-off ends of the longitudinal bars are, however, still inserted in the cutting sleeves 57 so that further rotation of the main disk 2 is not yet possible.

The feed frame 44 therefore now moves a short distance backwards, so that these ends are drawn out of the cutting bushes 57 and the plate 54, but still remain in the associated guide mouthpieces 39. During this small movement of the feed frame 44, the wires 33 have sufficient space behind the feed apparatus 21 to bend slightly and to absorb this movement. Once the longitudinal bar ends have been freed, the main disk 2 and hence also the supporting disk 51 rotate further through a cycle of 30°, so that a further group of six guide mouthpieces is now opposite the cutting devices 38. The feed frame 44 now moves to the left again, the cut-off ends of the longitudinal bars dipping into the respective central openings 58 of the supporting ring 40 and thus not impeding this movement. The movement of the feed frame 44 continues up to the delivery position in which all the guide mouthpieces 39 dip into the collecting funnels 9.

The feed apparatus 21 is now set in motion again. As soon as the front ends of this second group of wires project a few centimeters beyond the associated welding supports 7, the feed frame 44 moves backwards again, without the operation of the feed apparatus 21 being reduced. Once the intended limit position is reached and the two drives 25 and 32 are stationary, the cutting devices 38 come into action. After this, the feed frame 44 moves a short distance backwards again until the ends of the cut-off longitudinal bars are freed from the cutting devices 38. The welding supports 7 together with the collecting tubes 8 now move radially to the desired cage diameter. Once the diameter is reached, the supporting disk 3 moves to the front ends of the longitudinal bars and impacts against them slightly, in order to bring all the ends into a precisely radial plane if necessary. This is important in order that all the bar ends engage far enough into the clamping slots and the complete reinforcing cage is vertical. Finally, the clamping strips 6 snap closed and hold the ends fixedly. The winding process can start.

As a deviation from the half loading of the machine described, with twelve longitudinal bars, it is of course also possible to manufacture cages having only six or having twenty four longitudinal bars. In the latter case, the cyclic movement takes place three times, in each case by 15°. In addition, in the case of this machine, it is also possible to manufacture cages having four longitudinal wires, each displaced by 90° with respect to one another, by feeding in only two mutually diametrically opposite wires, or by feeding in two further wires once the main disk has been moved cyclically through 90°. The diameter of the reinforcing cages is also normally dimensioned larger or smaller in accordance with the number of longitudinal bars. For very small diameters, every second one of the slots 17 of the guide star 16 is moved close to the hollow shaft 14.

A wire feed device having more or less than six feed channels can also be provided, depending on the maximum number of the longitudinal bars to be fed into the machine. In addition, the maximum number of longitudinal bars which can be held by the machine may correspond to the number of feed channels of the wire feed device so that the machine can be fitted in a single process, without cycling.

The proposed wire feed device is thus suitable for all of the wide range of usage possibilities of the reinforcing cage winding machine known per se, and in any case considerably reduces the setting up time. Modern, programmable controls for the individual drives allow all the movement processes which can be carried out simultaneously also to run simultaneously and hence allow the maximum possible time saving to be achieved.

We claim:

1. In a machine for making reinforcing wire cages, including a main disk;

a supporting disk positioned spaced from and in axial alignment with said main disk;

a plurality of first holding means distributed in a circumferential array on said main disk for holding a plurality of parallel-spaced, linearly extending longitudinal wires;

a plurality of collecting funnels secured to said main disk at said first holding means and extending in a direction oriented away from said supporting disk;

a plurality of second holding means distributed in a circumferential array on said supporting disk for holding the wires in cooperation with said first holding means;

means for displacing said supporting disk towards and away from said main disk; and means for rotating said main disk and said supporting disk in synchronism;

the improvement comprising a wire feed device situated adjacent said main disk; said main disk being positioned between said wire feed device and said supporting disk; said wire feed device including (a) a feed apparatus having feeding means for advancing each longitudinal wire towards a respective said collecting funnel;

(b) a feed frame positioned between the feed apparatus and said main disk;

(c) a plurality of guide tubes each receiving a separate longitudinal wire and each having opposite first and second ends; the first end of each guide tube being supported on said feed apparatus;

(d) a guide tube supporting means connected to said feed frame for supporting each guide tube at said second end thereof;

(e) a cutting mechanism mounted on said guide tube supporting means at said second end of each said guide tube for severing each longitudinal wire; and (f) means for displacing said feed apparatus and said feed frame as a unit toward and away from said main disk.

2. The machine as defined in claim 1, further comprising (g) a plurality of guide mouthpieces providing a passage for each longitudinal wire;

(h) an additional supporting disk carrying said guide mouthpieces such that a separate said guide mouthpiece immediately adjoins a separate said cutting mechanism and being situated between said guide tube supporting means and said main disk;

(i) means for coupling said additional supporting disk to said main disk to effect rotation of said additional supporting disk in unison with said main disk; and (j) means for coupling said additional supporting disk to said feed frame to effect movement of said additional supporting disk in unison with said feed frame toward and away from said main disk.

3. The machine as defined in claim 2, wherein said mans for coupling said additional supporting disk to said main disk comprises a shaft affixed to said main disk coaxially therewith; said additional supporting disk being mounted on said shaft and being torque-transmittingly and axially relatively slidably connected therewith.

4. The machine as defined in claim 1, wherein the number of said first holding means equals the number of said second holding means; further wherein the number of said guide tubes equals the number of the cutting mechanisms; and further wherein the number of said guide tubes is equal to an integer fraction of the number of said first holding means.

5. The machine as defined in claim 4, further comprising a supporting ring carrying said cutting mechanisms in a circular array; said support ring having apertures in a circular array between said cutting mechanisms for allowing passage of the longitudinal wires.

6. A machine for making reinforcing wire cages, comprising (a) a shaft;

(b) a main disk mounted on said shaft;

(c) a supporting disk positioned spaced from and in axial alignment with said main disk;

(d) a plurality of first holding means distributed in a circumferential array on said main disk for holding a plurality of parallel-spaced, linearly extending longitudinal wires;

(e) a plurality of collecting tubes secured to said main disk at said first holding means and extending in a direction oriented away from said supporting disk;

(f) a plurality of second holding means distributed in a circumferential array on said supporting disk for holding the wires in cooperation with said first holding means;

(g) means for displacing said supporting disk towards and away from said main disk;

(h) means for rotating said main disk and said supporting disk in synchronism;

(i) means for radially moving said collecting tubes at said main disk relative to said main disk; and (j) a guide star mounted on said shaft at a distance from said main disk; said main disk being situated between said supporting disk and said guide star; said guide star having radial slots for supporting therein, in a circular array, said collecting tubes at locations spaced from said main disk.

7. A method of fitting longitudinal wires into first and second holding means arranged in circular arrays on a main disk and on a supporting disk, respectively, of a machine for producing reinforcing cages for concrete pipes; comprising the following cyclical, consecutive steps:

(a) simultaneously advancing a plurality of longitudinal wires of indeterminate length in separate guide tubes through respective first holding means to respective second holding means in a uniform circular distribution; the number of simultaneously advanced wires being an integer fraction of the number of the first holding means;

(b) severing each wire at a location upstream of said main disk as viewed in a direction of advance of the wires; and (c) simultaneously rotating said main disk and said supporting disk through an angle for aligning each guide tube with a respective said holding means not yet occupied by a wire.

* * * * *